United States Patent [19]

Luce et al.

[11] 4,046,049

[45] Sept. 6, 1977

[54] FOOT CONTROL APPARATUS FOR ELECTRONIC MUSICAL INSTRUMENT

[75] Inventors: David A. Luce, Clarence Center; Anthony Marchese, Cheektowaga, both of N.Y.

[73] Assignee: Norlin Music, Inc., Williamsville, N.Y.

[21] Appl. No.: 479,539

[22] Filed: June 14, 1974

[51] Int. Cl.[2] ..... G10H 1/02; H01C 10/10

[52] U.S. Cl. ..... 84/1.11; 84/1.19; 84/1.27; 84/478; 84/DIG. 25; 338/108; 338/153; 338/176

[58] Field of Search ..... 84/1.01, 1.17, 1.24, 84/1.27, 423, 426, 444, 464, 433, 478, DIG. 7, DIG. 8, DIG. 9, DIG. 17, DIG. 23, DIG. 25, 1.09–1.11, 1.19; 338/69, 108, 153, 176

[56] References Cited

U.S. PATENT DOCUMENTS

| | | | |
|---|---|---|---|
| 1,559,427 | 10/1925 | Hemphill | 338/153 X |
| 2,308,199 | 1/1943 | Mullenbach | 338/153 X |
| 2,460,494 | 2/1949 | Eisenberg et al. | 338/153 X |
| 2,986,953 | 6/1961 | De Armond et al. | 338/153 X |
| 3,342,094 | 9/1967 | Wilson | 84/423 |
| 3,433,881 | 3/1969 | Cotton | 84/1.17 |
| 3,553,338 | 1/1971 | Holman | 84/1.24 X |
| 3,560,629 | 2/1971 | Tucci | 84/1.27 |
| 3,585,893 | 6/1971 | Arseneault | 84/1.17 |
| 3,591,700 | 7/1971 | Neubauer et al. | 84/1.24 |
| 3,681,507 | 8/1972 | Slaats et al. | 84/1.24 X |
| 3,749,810 | 7/1973 | Dow | 84/1.24 |
| 3,771,406 | 11/1973 | Wheelwright | 84/464 |
| 3,845,446 | 10/1974 | Wolf | 338/153 |
| 3,858,148 | 12/1974 | Hauenstein | 338/153 X |

*Primary Examiner*—Stanley J. Witkowski
*Attorney, Agent, or Firm*—Hill, Gross, Simpson, Van Santen, Steadman, Chiara & Simpson

[57] ABSTRACT

An electronic synthesizer instrument incorporates bass pedals for the notes of the musical scale, together with foot control apparatus adapted to select and modify the tone quality of sounds produced by operation of the bass pedals. The foot control apparatus includes push button switches which are operated by the toe of an operator's foot, and slide controls which are positioned by the operator's foot. At least some of the switches are preset switches for selecting and controlling multiple combinations of the functional units of the synthesizer. The control state of the instrument is at all times indicated by readily observable indicating lights.

9 Claims, 3 Drawing Figures

FOOT CONTROL APPARATUS FOR ELECTRONIC MUSICAL INSTRUMENT

BACKGROUND

1. Field of the Invention

The present invention relates to foot control apparatus for an electronic musical instrument, and more particularly to such an instrument adapted to be controlled in its operation entirely by the feet of an operator.

2. The Prior Art

In the performance of musical compositions, accompaniment is frequently desirable, in the form of sounds produced concurrently with, and complementary to, the sound of a solo instrument. In some cases automatic apparatus is used to generate accompaniment sounds on a continuous, regular basis. It is desirable to change the quality of the accompaniment sounds during the performance of the composition, however, and this is not ordinarily possible when it requires the attention of the soloist to be diverted from the playing of the solo instrument.

While another musician, if available, could produce the accompaniment sounds without requiring the attention of the soloist, it is, of course, more economical to produce the required accompaniment sounds with as few musicians as possible.

One type of accompaniment sounds which is desirable is bass-type sounds. Although many instruments have been devised for producing bass-type sounds, most of them require the full attention of a musician. Only in keyboard instruments, such as organs, has a means been provided in the past for permitting the production of bass-type sounds, by providing a pedal clavier for that purpose. By this means, a musician can produce bass-type sounds by using his feet. Customarily, hand-operated controls are provided on the control panel of the organ for controlling the pitch and other qualities of the sounds produced in response to pedal operation.

The bass pedal systems heretofore known are limited to the production of certain limited types of bass tones, and even these generally require the musician to manipulate manual controls, which diverts his attention from playing a solo instrument.

It is therefore desirable to provide apparatus capable of producing accompaniment or bass-type sounds which is not limited in the ways that prior art apparatus has been limited.

SUMMARY OF THE PRESENT INVENTION

It is a principal object of the present invention to provide a bass pedal synthesizer instrument capable of being operated and controlled entirely by the feet of an operator or player.

Another feature of the present invention is to provide such a synthesizer equipped with means for enabling an operator to control a variable parameter in a continuous manner by means of a foot-operated slide control.

A further object of the present invention to provide such a synthesizer including a plurality of foot-operated preset controls, each functioning to set up the system into a predetermined preset condition.

A further object of the present invention is to provide such a synthesizer incorporating indicator lights for illustrating the current operating condition of the instrument.

These and other objects and advantages of the present invention will become manifest upon an examination of the following description and the accompanying drawings.

In one embodiment of the present invention there is provided a synthesizer instrument housed in a floor-supported case near the location of an operator's feet, said instrument having a plurality of foot-operable push button switches for controlling production and modification of sounds, a plurality of such push button switches being adapted to set up the instrument into a predetermined configuration for production of a predetermined combination of sound qualities, and a plurality of indicator lights for indicating the current configuration of the instrument.

BRIEF DESCRIPTION OF THE DRAWINGS

Reference will now be made to the accompanying drawings, in which.

DESCRIPTION OF THE PREFERRED EMBODIMENTS

Figure 1:
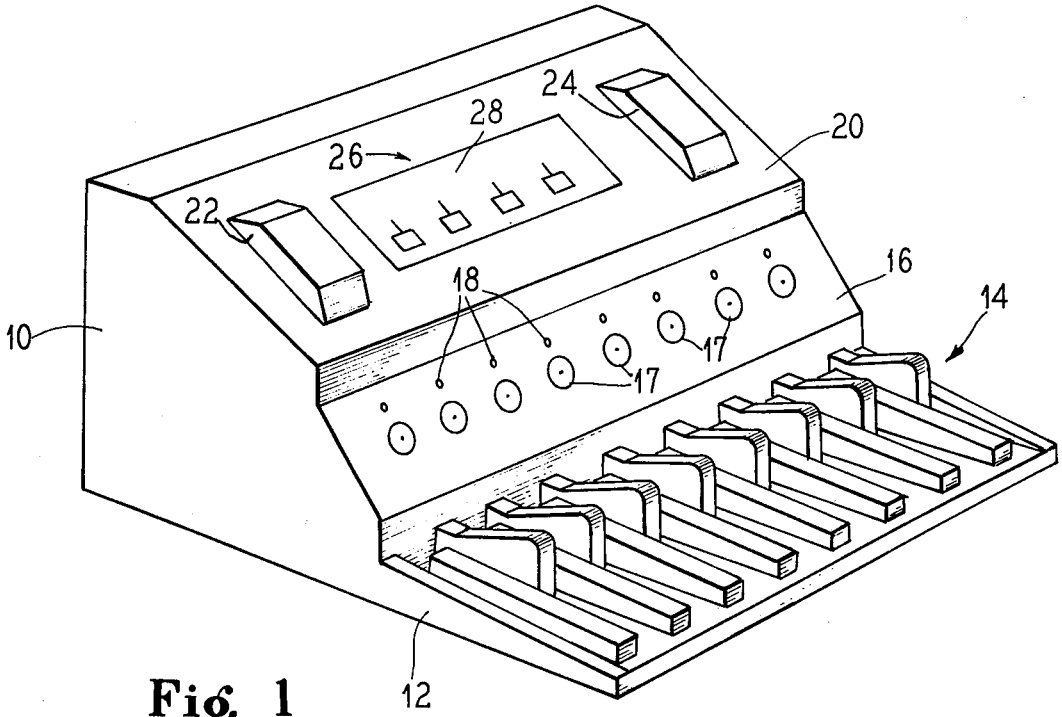
FIG. 1 is a perspective view of a bass pedal synthesizer incorporating an illustrative embodiment of the present invention.

Referring first to FIG. 1, a bass pedal synthesizer incorporating an illustrative embodiment of the present invention has a case 10 including a base 12 adapted to rest on the floor near the feet of the musician. A plurality of bass pedals 14 are mounted on the base 12, and they comprise 13 pedals (for an octave plus one note) arranged in the customary manner as with organs. The pedals 14 are operated by the foot of the player in the ordinary manner.

Located behind and slightly above the pedals 14, the case 10 has a sloping panel 16, on which are mounted a plurality of push button switches 17. The switches 17 are housed within the case 10 behind the panel 16, but their operating members or push buttons protrude upwardly through openings in the panel 16 for engagement by the toe of an operator's foot. A plurality of indicator lights 18 are also positioned behind openings in the panel 16 above the push buttons 17, there being one indicator light 16 for each of the push buttons 17. The indicator lights serve to indicate the state or condition of the circuitry controlled by operation of their associated push buttons 17. Located above and behind the panel 16 is a sloping panel 20, on which is provided two foot-operated slider members 22 and 24. These slider members are engageable by the player's foot and are movable back and forth on the surface of the panel 20. Between the two slider members 22 and 24, a plurality of function controls 26 are provided for controlling certain functions of the instrument. Preferably, the controls 26 are located in a recess provided below the panel 20 and are protected by a transparent cover 28 hinged to the panel 20 and overlying the switches 26. The condition of the controls 26 can be observed visually through the transparent cover 28, but the presence of the cover 28 prevents the controls 26 from being inadvertently disturbed by the foot of an operator during playing of the instrument. The controls 26 are used to set up in an initial condition before the instrument is used in a performance or the like, and the controls 26 will remain in their same settings throughout an entire performance. The controls 26 cooperate, however, with other control devices operated by the push buttons 17, as described in detail hereinafter.

The rectilinear slider members 22 and 24 allow the operator to adjust, by his feet, variable parameters associated with the production of the accompaniment sounds. Preferably one of the slider members is employed to control the loudness or volume of the accompaniment sounds, and the other slider control is used to provide a means for adjustably controlling the cutoff frequency of a filter which is interposed in the electrical path between a signal source and an output system. Controlling the cutoff frequency makes is possible to produce markedly different sound qualities, and it is therefore very useful to have this control adjustable on a continuous basis by the foot of the player, so that sound qualities can be changed at will in accordance with the musical effects desired by the operator.

Figure 2:
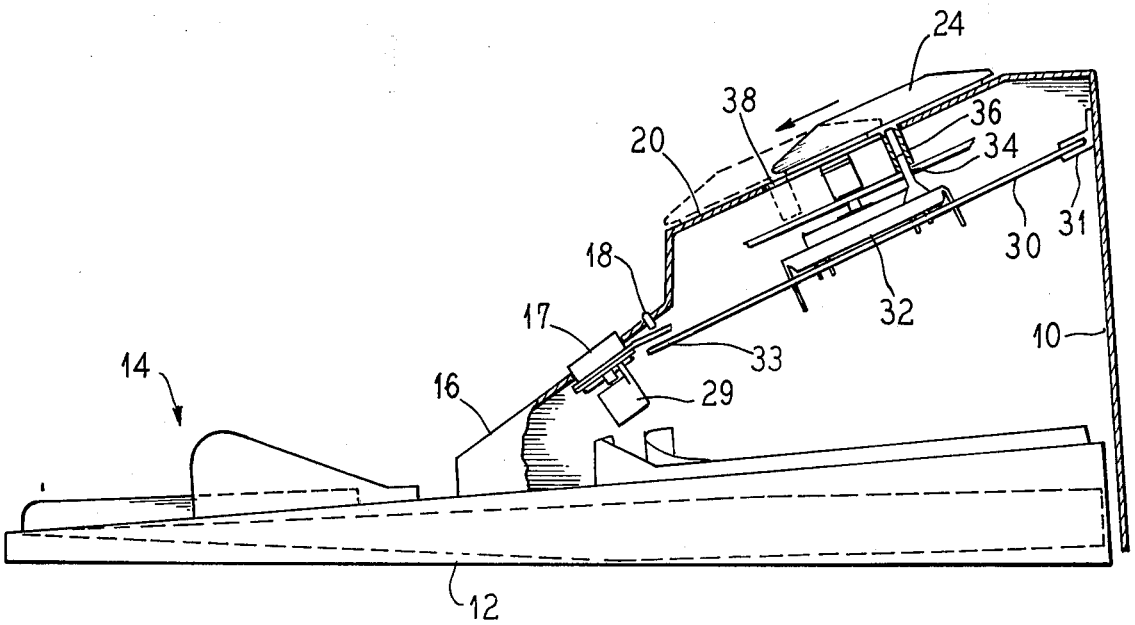
FIG. 2 is a side elevational view, partly in cross section, of the apparatus of FIG. 1.

Referring to FIG. 2, it can be seen that the push button 17 of a switch 29 protrudes upwardly through an aperture in the panel 16, and the light 18 also protrudes through the panel 16. Similarly, the slider member 24 is mounted for sliding movement on the panel 20. Secured to the interior of the case 10 is a supporting shelf 30, which is supported at its rear edge by a bracket 31 mounted within the case 10 on its rear wall, and by a bracket 33 mounted within the forward part of the case 10. The shelf 30 is generally located parallel to the panel 20 and is spaced slightly below it. On the shelf 30, a variable resistance control 32 is mounted, with the operating shaft 34 of the slide control 32 extending upwardly toward the panel 20, and completing an operating link between the slider member 24 and the control 32. The slider member 24 is provided with a downwardly extending tube 36, and the tube is adapted to receive the operating shaft 34, so that the operating shaft 34 can be moved as a result of movement of the slider member 24 by the player's foot. A slot 38 is provided in the panel 20 to allow limited movement of the slider member 24, and the tube 36 bears on one of the ends of the slot 38 in order to limit the total movement of the slider member 24. The player is free to rest as much weight as he desires on the slider member 24. This force is not transmitted to the control unit 32, but bears on the strong and rigid case 10, through the panel 20. Thus, the variable resistance control 32 is not required to withstand any large forces. It is therefore possible to use a relatively sensitive construction for the varible resistance control element 32 without risking damage during use.

Figure 3:
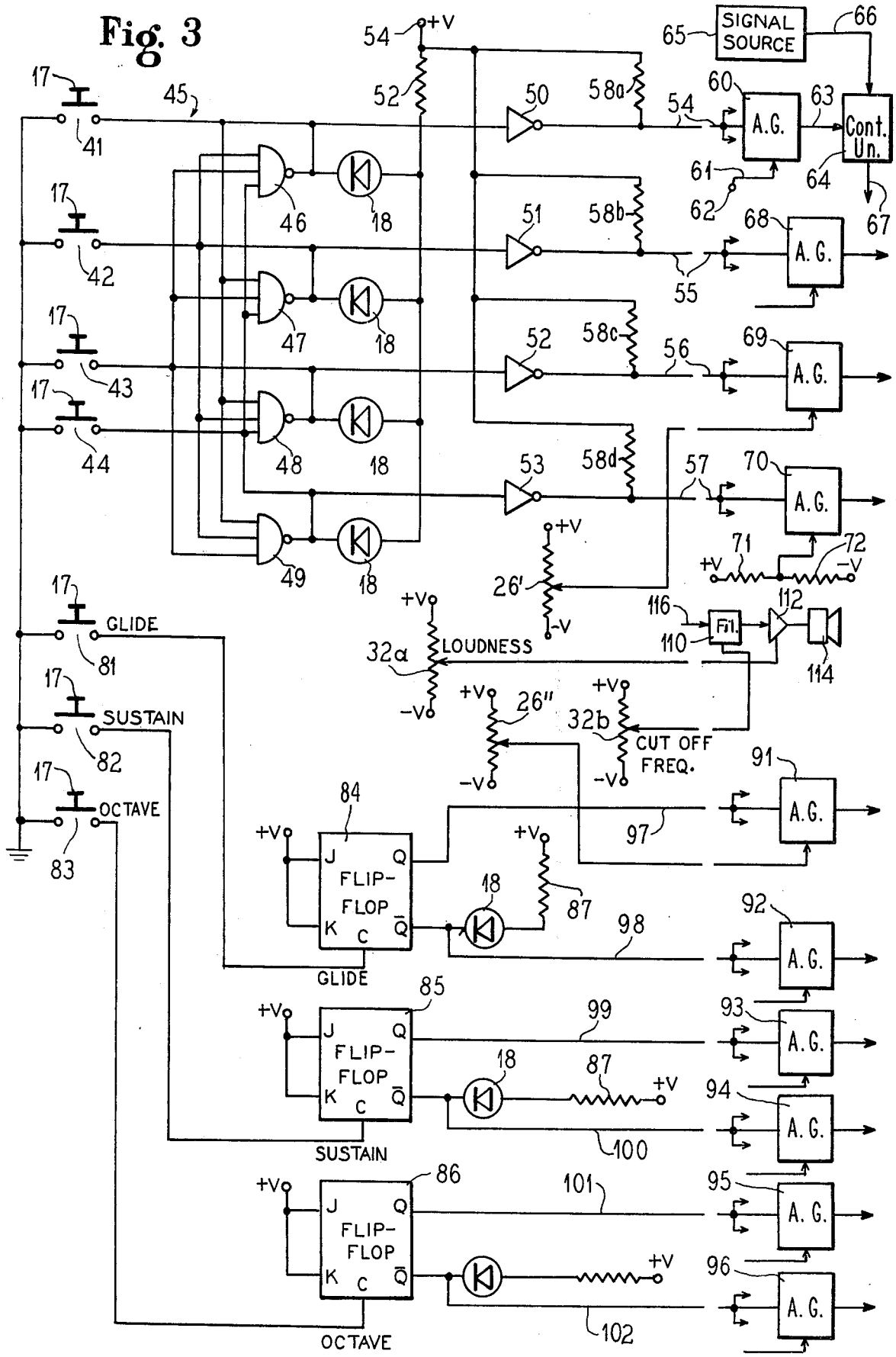
FIG. 3 is a schematic circuit diagram, partly in functional block diagram form, of a portion of the control circuit of the apparatus of FIG. 1.

Referring now to FIG. 3, a control circuit mounted within a preferred embodiment of the present invention is illustrated.

The seven foot-operated push buttons 17 are illustrated toward the left-hand side of the diagram. Four of these push buttons operate four momentarily acting switches 41–44, which are sometimes referred to hereinafter as "preset control switches," in that they establish one of four different operating conditions of a preset circuit 45. The preset circuit includes four NAND gates 46–49, which are cross coupled, each of the three inputs of the gates 46–49 being connected to the outputs of the other three gates. In this way, only one of the gates produces a low output, with the other three gates producing high levels at their outputs. There are, therefore, four mutually exclusive stable states which the preset circuit 45 may assume, depending upon which of the switches 41–44 was last operated, and so the circuit 45 may be referred to as a multi-state device. Each of the switches 41–44 is connected between the output of one of the four gates 46–49 to ground, to momentarily hold the output of its respective gate at a low potential, which results in the de-energization of the other three gates. This state is maintained until another one of the switches 41–44 is energized, even after the player's foot is removed from the push button 17.

A light emitting diode (or LED) 18 is connected individually from the output of each of the gates 46–49 and in common through a resistor 52 to a source of positive potential connected to a terminal 54. Only one of the four LED's 18 connected to the gates 46–49 is illuminated, namely, that corresponding to the gate which is energized and which, therefore, has a low potential at its output.

The outputs of the gates 46–49 are each connected to a separate inverter 50–53 to one of a series of output lines 54–57. A pull up resistor (58*a* – 58*d*) is connected from each of the output lines 54–57 to the terminal 54 to maintain the selected output line at a high level, while the other output lines are maintained at a low level by their respective inverters. Since only one of the output lines 54–57 may have a high level at any one time, the high level signals on all the lines 54–57 are mutually exclusive or unique.

The output lines 54–57 are employed to establish connections in a particular configuration within the synthesizer structure. They are illustrated in FIG. 3 with a break to illustrate that the gates and other circuitry which they control, and which is illustrated on the righthand side of FIG. 3, may, if desired, be located at a remote location from the case 10. The output line 54 is connected to the control inputs of an analog gate 60, which has a signal input 61 connected from a terminal 62 and an output line 63. When the preset unit 45 is in its state which enables the output line 54 to go high, the gate 60 is enabled to pass signals from the terminal 62 to the line 63. The line 63 is connected to the control input of a control unit 64, having an input connected by a line 66 to a signal source 65 and having an output line 67. The control unit 64 may comprise a mixer, a modulator, a filter, or the like, which operates as a functional unit in the synthesizer instrument to assist in producing a certain sound quality. The terminal 62 has a specific voltage applied thereto so that, when the gate 60 is operated, by energization of the line 54, the control unit 64 performs a certain prescribed effect on the signal produced by the source 65 so as to give the signal the characteristics which produce the desired effect on the resultant sound produced by the instrument.

Similar analog gates 68–70 are connected to the other output lines 55–57 of the preset unit 45 and are enabled selectively in accordance with the condition of the preset unit 45. When the line 56 is high, the gate 69 is energized. The gate 69 has its signal input connected to a potentiometer 26', which is one of the controls 26 mounted on the panel 20 of the instrument. The output of the gate 69 is a potential which is dependent upon the setting of the tap of the potentiometer 26'. Thus, the preset unit 45 operates in conjunction with the control 26'. The control input to the gate 70, which is energized when the line 57 is high, is a fixed potential derived from a voltage divider incorporating resistors 71 and 72.

Each of the gates 68–70 produces a potential on an output line for modifying or controlling the production of sound in prescribed ways. The outputs of some of the gates 68–70 may be connected in parallel with the output of the gate 60, to control the operation of the control unit 64 in certain predetermined ways. Alternatively, they may be connected to the control inputs of other control units connected in parallel with the control unit 64, so as to establish different transmission parameters affecting the signal produced on the line 67.

Each of the output lines is preferably connected to a plurality of gates such as the gates 60 and 68–70 so that a plurality of functional units of the synthesizer may be controlled in a preselected way, responsive to the state of the preset unit 45. A more complete description of certain control units which may be employed, along with the cooperating structure of the synthesizer unit, is found in the co-pending applications of David A. Luce filed of even date herewith, assigned to the assignee of the application, Ser. Nos. 479,443 and 479,485, entitled "Preset System for Electronic Musical Instrument" and "Electronic Musical Instrument with Dynamically Responsive Key-board." A variety of voltage controlled units are disclosed therein, and reference is made thereto for the details of construction of control units which may be employed in the bass synthesizer of the present invention.

Three additional push button switches 81–83 are illustrated in FIG. 3. Each of them is connected between ground and a clock input of a JK flip-flop 84–86, respectively. The J and K inputs of the flip-flop 84–86 are all connected to a source of positive potential so that the state of each of the flip-flops changes each time its push button switch is operated. The $\overline{Q}$ output of each flip-flop is connected to an LED 18, and the LED's are connected individually through resistors 87 to a source of positive potential, so that they are illuminated only for the flip-flops which are in their set states, having low $\overline{Q}$ outputs.

The Q and $\overline{Q}$ outputs of the flip-flops 84–86 are individually connected to analog gates 91–96 via output lines 97–102. The gates 91–96 are employed in the same way as the gates 60 and 68–70, to control the operation of certain control units which are associated with functional units of the synthesizer instrument. Preferably, the gates 91–96 are employed to control certain specific functions on an on-off basis. The gates 91 and 92, operated by the flip-flop 84, control the operation of the glide function, and select two different values of a glide parameter, depending on the state of the flip-flop 84. One value may be zero, in which case one of the gates may be omitted. Another value is variable, in accordance with the setting of a potentiometer 26″, one of the controls 26. The LED's associated with the switch 81 indicate to the player the current state of the glide flip-flop 84.

The flip-flop 85 is employed to establish two different values of a sustain parameter, and the flip-flop 86 controls an octave selecting function. When the flip-flop 86 is set, the pitch of the sounds produced by the instrument are sounded at one octave higher than when the flip-flop is not set. Control circuits for controlling the glide, sustain, and octave selection functions are described in the co-pending applications of David A. Luce filed concurrently herewith, assigned to the assignee of their application, Ser. Nos. 479,444 and 479,485, entitled "Electronic Musical Instrument with Exponential Keyboard and Voltage Controlled Oscillator" and "Electronic Musical Instrument with Dynamically Responsive Keyboard."

The slider members 22 and 24 (FIG. 1) control the position of the taps of potentiometers **32*a* and 32*b*, which control the cutoff frequency of a filter 110 and the gain of an amplifier 112 which forms part of the output system of the instrument and drives a loudspeaker 114. An input line 116 of the filter 110 is connected to the output of at least one control unit such as the control unit 64, so as to receive the controlled signal of the signal source 65, so that the loudspeaker 114 can produce the desired sounds. The signals produced by switches closed when the various pedals 14 are depressed are used to control operation of the signal source 65** to produce sounds with pitches corresponding to the operated pedals. The means for doing this forms no part of the present invention and therefore need not be described specifically.

In a preferred embodiment of the present invention, the NAND gates, inverters, and flip-flops are standard 7,400 series types, and the analog gates, such as 60, 68–70, etc., are model 4016 integrated circuits commercially available from RCA.

It will be appreciated that the present invention enables a player to execute complete control over the operation of a synthesizer instrument, using only foot controls to turn functions on and off, to regulate or adjust functions on a continuous basis, and to select one of a number of preset configurations of the apparatus. The current states of the various units are indicated by the LED's 18, and the states can easily be changed at a touch of the player's toe. Various modifications and additions may be made in the apparatus illustrated and described without departing from the essential features of novelty thereof, which are intended to be defined and secured by the appended claims.

What is claimed is:

1. For use with a foot-controlled electronic musical instrument, a variable element for varying an electrical parameter, a case for housing said variable element, a movable operating member connected with said variable element for controlling said parameter, said operating member being adapted for rectilinear movement by the foot of the player of the instrument, means for mounting said operating member in slidable relation with a wall of said case, means for mounting said variable element directly on the other side of said wall from said operating member, and link means for connecting said variable element with said operating member whereby the force transmitted to said operating member by said player's foot is resisted by said wall and is not transmitted to said variable element.

2. Apparatus according to claim 1, including a shelf mounted within said case for supporting said variable element spaced from said wall, and said link means comprises a telescoping rod and tube, connected between said variable element and said operating member, said rod being received in sliding relationship within said tube.

3. A foot-controlled synthesizer instrument for producing sounds having different qualities in response to the condition of a plurality of foot-operated control units, comprising in combination, a plurality of control units interposed in a transmission path between a signal source and an output system, each of said control units being operative to modify the quality of the sound produced by said synthesizer by modifying a characteristic of said transmission path, and a plurality of foot-operated switches for simultaenously controlling preselected combinations of said control units and including multi-state means for generating unique signals on a plurality of control lines independent of said transmission path, preset means connected between said control lines and said control units for simultaneously causing said control units to establish a plurality of predetermined combinations of transmission characteristics, and for operating said control units in accordance with the state of said multi-state means, and foot-operated switch means for selecting the state of said multi-state means.

4. Apparatus according to claim 3, wherein a plurality of said control units are controlled in response to the magnitude of a control voltage, and wherein said preset means includes means for developing predetermined control voltages for said control units in response to particular states of said multi-state means.

5. Apparatus according to claim 4, wherein said preset means includes analog gates interconnected between said multi-state means and said control units.

6. Apparatus according to claim 3, including means for visually indicating the current condition of operation of said control units.

7. Apparatus according to claim 6, including individual indicating means for each of a plurality of said switches, for indicating the current condition of operation of said control units individually in response to said switches.

8. Apparatus according to claim 3, wherein said instrument is provided with a case for housing said switches, and including a slider member mounted in sliding relation with said case, variable means for varying an electrical parameter connected with said slider member for operation thereby, and means connecting said variable means with one of said control units.

9. A foot-controlled synthesizer instrument for producing sounds having different qualities in response to the condition of a plurality of foot-operated control units, comprising in combination, a plurality of control units interposed in a transmission path between a signal source and an output system, each of said control units being operative to modify the quality of the sound produced by said synthesizer by modifying a characteristic of said transmission path, and a plurality of foot-operated switches for simultaneously controlling preselected combinations of said control units and including a variable element for varying an electrical parameter connected with one of said control units for controlling said control unit in accordance with said parameter, a movable operating member connected with said variable element for controlling said parameter, said operating member being adapted for movement by the foot of a player of the instrument, means for mounting said operating member in slidable relation with a supporting wall, and link means for connecting said variable element with said operating member whereby the force transmitted to said operating member by said player's foot is resisted by said supporting wall and is not transmitted to said variable element.

* * * * *